US010304595B2

(12) United States Patent
Weatherbee et al.

(10) Patent No.: US 10,304,595 B2
(45) **Date of Patent: *May 28, 2019**

(54) ELECTRIC BUSHINGS HAVING INSULATION MEDIUM RETENTION SEALS

(71) Applicant: HUBBBELL INCORPORATED, Shelton, CT (US)

(72) Inventors: Eric Ralph Weatherbee, Attica, NY (US); Andrew Victor McNulty, Spencerport, NY (US); Shibao Zhang, Pittsford, NY (US); Chungduck Ko, Mendon, NY (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/016,385

(22) Filed: Jun. 22, 2018

(65) Prior Publication Data

US 2018/0301250 A1 Oct. 18, 2018

Related U.S. Application Data

(63) Continuation of application No. 14/947,100, filed on Nov. 20, 2015, now Pat. No. 10,032,546.

(60) Provisional application No. 62/082,370, filed on Nov. 20, 2014.

(51) Int. Cl.
*H01B 17/30* (2006.01)
*H01B 17/34* (2006.01)

(52) U.S. Cl.
CPC ..... *H01B 17/301* (2013.01); *H01B 17/34* (2013.01)

(58) Field of Classification Search
CPC ..... H01B 17/301; H01B 17/34
USPC ..... 174/152 G
See application file for complete search history.

(56) References Cited

U.S. PATENT DOCUMENTS

| | | | | |
|---|---|---|---|---|
| 3,760,089 | A | 9/1973 | Hildenbrand | |
| 4,214,119 | A * | 7/1980 | Keen, Jr. | H01B 17/30 174/18 |
| 4,609,775 | A | 9/1986 | Moran | |
| 5,200,578 | A | 4/1993 | Brucker | |
| 8,948,216 | B1 | 2/2015 | Choi | |

OTHER PUBLICATIONS

International Search Report from corresponding International Application No. PCT/US2015/061802 dated Feb. 5, 2016.

(Continued)

*Primary Examiner* — Dhiru R Patel
(74) *Attorney, Agent, or Firm* — Ohlandt, Greeley, Ruggiero & Perle, L.L.P.

(57) ABSTRACT

Systems and methods for providing electrical bushings for maintaining a seal during severe incidents are provided. The bushings provide for relatively large gap formations and seal spacings by using one or more self-modulating seals. In certain configurations, the bushings provide for relatively large gap formations and seal spacings by using a wider or narrow top portion adjacent to a relatively narrower middle portion. The systems and methods can be also applied to other apparatus when deemed proper.

15 Claims, 15 Drawing Sheets

(56) References Cited

OTHER PUBLICATIONS

Written Opinion from corresponding International Application No. PCT/US2015/061802 dated Feb. 5, 2016.
"Transmission Grid Research", California Institute for Energy and Environment, Feb. 2012.
International Preliminary Report on Patentability dated Jun. 1, 2017 from corresponding International PCT Application No. PCT/US2015/061802, 8 pages.

* cited by examiner

ELECTRIC BUSHINGS HAVING INSULATION MEDIUM RETENTION SEALS

CROSS REFERENCE TO RELATED APPLICATION

This application is application is a continuation of U.S. application Ser. No. 14/947,100 filed on Nov. 20, 2015, which issued as U.S. Pat. No. 10,032,546 on Jul. 24, 2018, which claims the benefit of U.S. Provisional Application No. 62/082,370 filed Nov. 20, 2014, the contents of both of which are incorporated by reference herein.

BACKGROUND

1. Field of the Invention

The present application is directed to electrical bushings and more, particularly, is directed to electrical bushings having seals that provide improved insulation medium retention, particularly during severe incidents.

2. Description of Related Art

Electrical bushings are used for transferring electrical power through a grounded interface. Such bushings are typically found in power systems, such as electric power transmission and distribution substations, allowing for electrical power to pass between power transmission lines through the electrically grounded wall of an apparatus, typically a transformer; circuit breaker; generator; reactor or building.

Typical bushings consist of a central electrical conductor, which carries the electrical power, surrounded by a high dielectric insulation medium such as mineral oil and oil-impregnated paper. Retention of the insulation medium has proven difficult particularly in view of the conditions to which such bushings are often exposed. For example, bushings can be exposed to dynamic loads imparted by wind, seismic events such as earthquakes, impacts, other dynamic loads, and any combinations thereof.

Accordingly, it has been determined by the present application that there is a need for bushings having seals that alleviate, mitigate or otherwise improve upon one or more of the aforementioned and/or other deleterious effects of prior art bushings

SUMMARY

The present application describes illustrative embodiments of systems and methods for maintaining effective sealing during severe incidents for electrical bushings. In some illustrative embodiments described herein the seals provide for relatively large gap formations between housing components and seal deformation compared to traditional designs. Providing for relatively large and asymmetrical separation of the illustrative bushing components allows the bushing to remain sealed during severe incidents such as random and dynamic loading during an earthquake, or extreme static bending.

In certain illustrative embodiments, a lower portion of a bushing insulator surrounds and is wider than an upper portion of a bushing mounting flange, i.e., the lower portion of the bushing insulator encapsulates the bushing mounting flange. In other illustrative embodiments, a lower portion of a bushing insulator is surrounded by and is narrower than an upper portion of a bushing mounting flange, i.e., the lower portion of the bushing insulator is encapsulated by the bushing mounting flange.

Certain illustrative embodiments described herein utilize a self-modulating seal that permits bushing components to be separated thus preventing cracking or rupturing of components such as a porcelain housing component. As used herein, the term "self-modulating seal" shall mean an omni-directional seal that adjusts sealing shape and pressure per the direct effects of the sealing environments input based on the bushing and or its components acceleration and their generated forces.

In some embodiments, the self-modulating seal can be an internal seal, an external seal, or combinations thereof. In other illustrative embodiments, the self-modulating seal can be a bonded seal (internal and/or external) that is utilized between an insulator and flange to provide for a seal when a bumper area is open.

An electrical bushing assembly is provided that includes a bushing insulator, a flange housing, a bushing medium disposed within the bushing insulator and the flange housing for fluid communication therebetween, and a self-modulating seal. The seal engages the first portion of the bushing insulator to a second portion of the flange housing in a fluid/gas tight manner.

In some embodiments, the electrical bushing assembly is sufficient to withstand IEEE 693-2005 shake table tests conducted at 2.5 g Zero Period Acceleration (ZPA).

In other embodiments alone or in combination with one or more of the aforementioned or aft mentioned embodiments, the first and second portions can be vertical surfaces.

In other embodiments alone or in combination with one or more of the aforementioned or aft mentioned embodiments, the bushing insulator is selected from the group consisting of an upper bushing insulator, a lower bushing insulator, and combinations thereof.

In other embodiments alone or in combination with one or more of the aforementioned or aft mentioned embodiments, the electrical bushing assembly can include a bumper between the bushing insulator and the flange housing. The self-modulating seal can seal the bumper from the bushing medium or the bumper can be immersed in the bushing medium. The bumper can be positioned between horizontal surfaces of the bushing insulator and the flange housing.

In other embodiments alone or in combination with one or more of the aforementioned or aft mentioned embodiments, the first portion can be larger than the second portion so that the bushing insulator surrounds the flange housing or the second portion can be larger than the first portion so that the flange housing surrounds the bushing insulator.

In other embodiments alone or in combination with one or more of the aforementioned or aft mentioned embodiments, the self-modulating seal can be at least one of an internal seal such that the first and second portions are internal surfaces and an external seal such that the first and second portions are external surfaces. In some embodiments, the self-modulating seal is adhered to at least one of the first and second portions.

In other embodiments alone or in combination with one or more of the aforementioned or aft mentioned embodiments, the self-modulating seal can be an internal seal such that the first and second portions are internal surfaces. Here, the self-modulating seal can have a planar surface in contact with the bushing medium or a notched surface in contact with the bushing medium. The electrical bushing assembly can also include a groove on at least one of the first and second surfaces, with the self-modulating seal received in the groove. The electrical bushing assembly can, in some embodiments, include a second self-modulating seal sealingly engaging an outer surface of the bushing insulator to an outer surface of the flange housing in a fluid/gas tight manner. The second self-modulating seal can be adhered to at least one of the outer surfaces of the bushing insulator and the flange housing.

An electrical bushing assembly is also provided that includes a flange housing having a groove on a first outer vertical surface; an upper bushing insulator having an inner vertical surface that surrounds the groove; a bushing medium disposed within the bushing insulator and the flange housing for fluid/gas communication there between; an internal self-modulating seal in the groove engaging the first vertical outer surface of the flange housing to the inner vertical surface of the upper bushing insulator in a fluid/gas tight manner, the internal self-modulating seal may have a notched surface in contact with the bushing medium; an external self-modulating seal engaging a vertical outer portion of the upper bushing insulator to a second vertical outer portion of the flange housing in a fluid/gas tight manner; and a bumper between horizontal surfaces of the bushing insulator and the flange housing, wherein the internal self-modulating seal seals the bumper from the bushing medium. In some embodiments, the electrical bushing assembly is sufficient to withstand IEEE 693-2005 shake table tests conducted at 2.5 g Zero Period Acceleration (ZPA).

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

For at least the reasons noted above, there is a need, among other needs, for improved bushings.

The illustrative embodiments of the present application describe systems and methods for providing bushings that remain sealed during severe incidents. The illustrative embodiments described herein provide for fluid and/or gas tight seals that allow for relatively large gap formations compared to traditional designs. Allowing for relatively large and/or asymmetrical separation of the illustrative bushing components in simultaneously multiple axes allows the bushing to remain sealed even during extreme random and dynamic events such as severe earthquakes.

In certain illustrative embodiments such as those in FIGS. 1-8, 11-17, and 18*a*-18*d*, a lower portion of a bushing insulator is surrounded by and is narrower than an upper portion of a bushing mounting flange. In other illustrative embodiments such as that in FIG. 10, a lower portion of a bushing insulator surrounds and is wider than an upper portion of a bushing mounting flange.

Certain illustrative embodiments described herein utilize a self-modulating seal that permits bushing components to be separated thus preventing cracking or rupturing of components such as a porcelain housing component.

Figure 7:
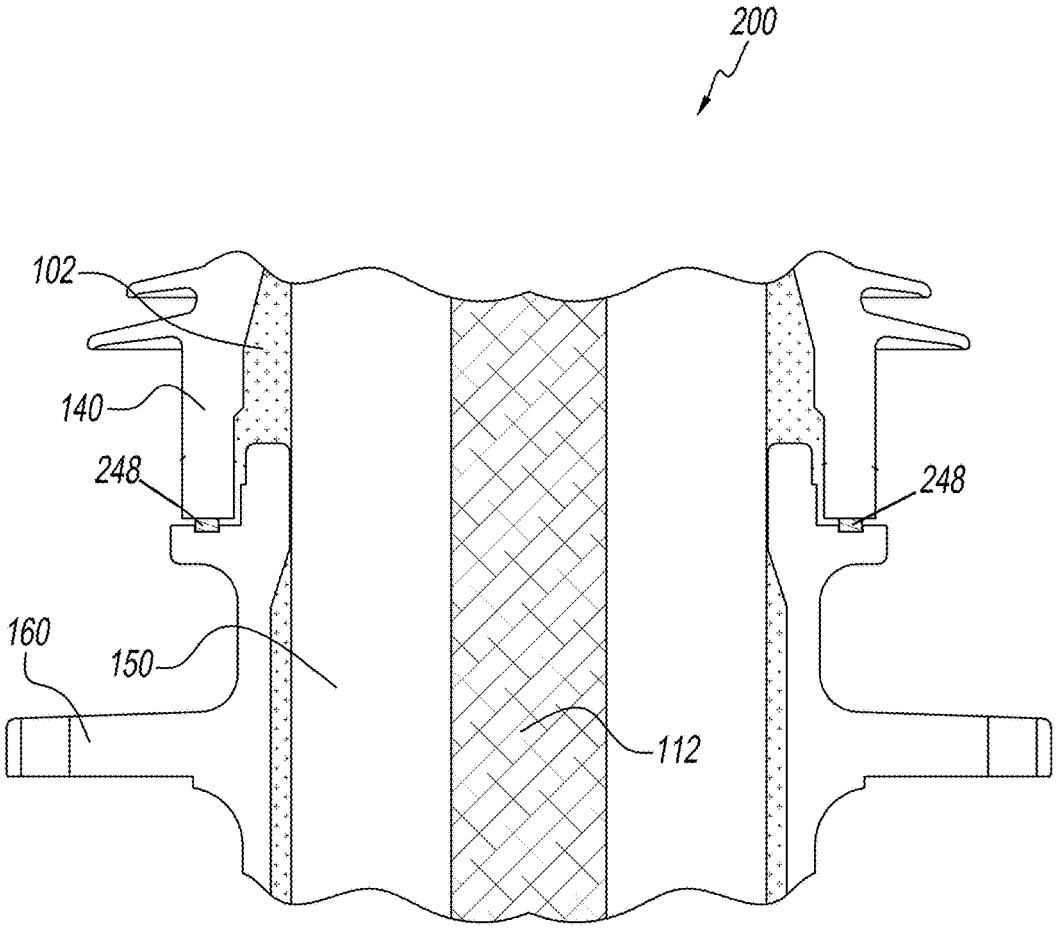
FIG. 7 is a magnified view of an alternate exemplary embodiment of a bushing according to the present application without application of an external load.
Figure 8:
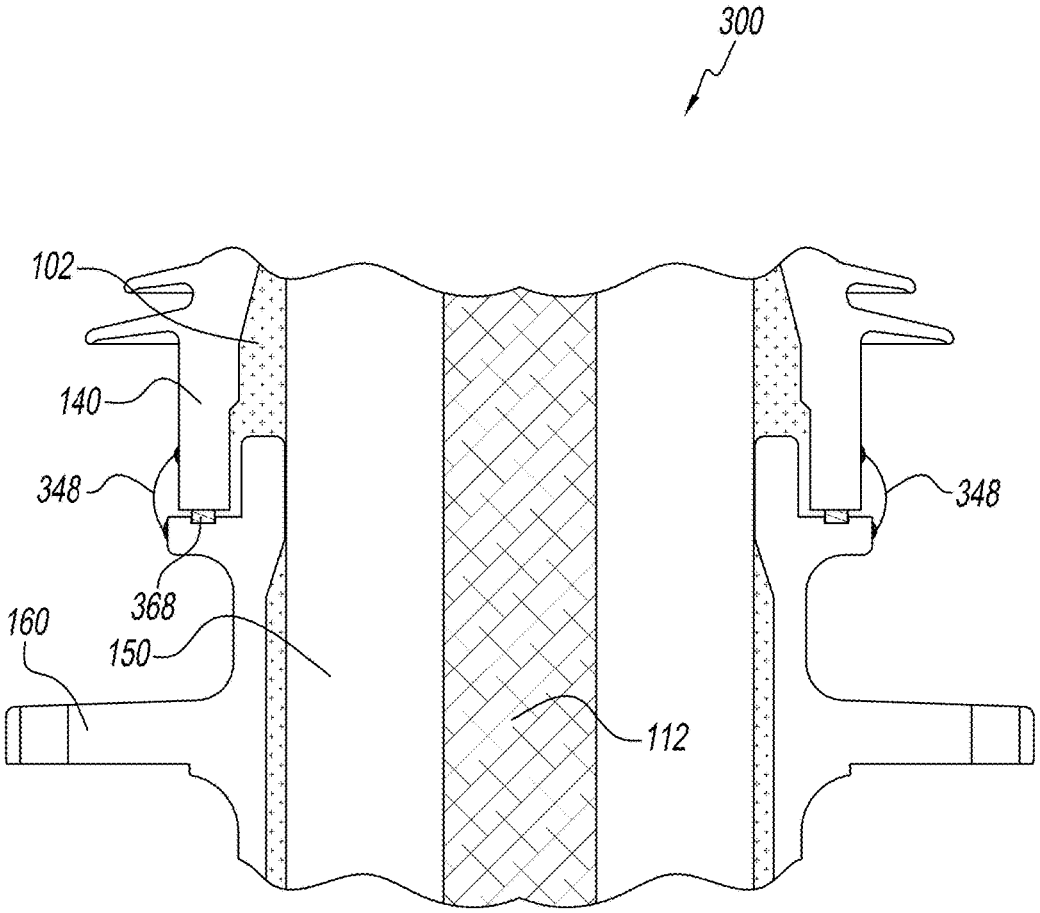
FIG. 8 is a magnified view of another alternate exemplary embodiment of a bushing according to the present application without application of an external load.

In other illustrative embodiments such as those of FIGS. 7 and 8, a bonded seal is utilized between an insulator and flange to provide for a seal when a bumper area is open. The bonded seal can be a bonded internal seal as in FIG. 7 or an external bonded seal as in FIG. 8. While not illustrated, the external bonded seal can be in combination with one or more embodiments of the internal seals, bonded or otherwise, disclosed herein.

Several of the illustrative embodiments described herein provide a novel and useful system for providing a self-modulating seal for use in bushings under extreme loading conditions. Unlike previous designs that attempt to prevent or limit the separation of the components and fail to seal when a large gap forms or the seal spacing is changed, the illustrative mechanisms of the illustrative embodiments of the present application allow for large and asymmetrical separation of bushing components during the extreme random and dynamic events such as the most severe earthquakes.

For example, during an earthquake, the ground typically shakes in three directions (x, y, and z) and varies with time. A bushing installed on top of a transformer experiences violent and random shaking, where the most vulnerable bushing designs will resonate with the earthquake. This resonant energy needs to be released. It has been determined by the present application that traditional bushings do not remain sealed in such extreme conditions. Advantageously, the seal provided in several of the illustrative embodiments described herein can modulate itself to different shapes to allow for the release of energy while also properly sealing the bushing, which is novel and useful.

Unlike the existing prior designs that try to seal by preventing or limiting the motion in all directions, the mechanism in several of the illustrative embodiments described herein allows the bushing parts to move more freely in the axial direction, translational direction, and rocking direction, even allowing bushing components to temporarily separate from each other. Accordingly, the bushing may maintain seal integrity even during a violent earthquake.

As described in several embodiments herein, a sealing system is provided by installing a seal inside the bushing between the flange and upper insulator where the maximum external moment is usually applied, as described for example in FIG. 1 below. Here, the seal can be said to serve as a static seal since it is properly compressed. When the bushing components are potentially separated during an earthquake or other dynamic load, the seal prevents the bushing core from being exposed to the external environment and air, which could lead to a catastrophic bushing failure. If necessary, this design can be installed at multiple vulnerable areas that may be of concern in certain designs.

The seal of several illustrative embodiments herein can respond to a large gap opening, for example, from a fraction of an inch to several inches, as long as the seal location is allocated accordingly and/or the seal size is designed accordingly.

When the dynamic loading is asymmetric, one side of the sealing space will be narrowed. The seal of several illustrative embodiments described herein will be more secure due to its material selection and shape. Also, during asymmetrical dynamic loading, one side of the seal spacing will be greatly enlarged with a big gap forming. When a gap forms because of the separation of bushing components, there is a pressure difference between the inside and outside surfaces of the seal (i.e., the inside of the seal experiences pressure for example from both the air on the bushing top headspace and the hydraulic head pressure from the bushing fluid or other insulating medium, while the outside of the seal only has pressure from the outside atmosphere air). The self-modulating seal system of this embodiment utilizes this pressure difference and modulates itself to seal the bushing under extreme dynamic conditions during for example a severe earthquake. Traditional bushings would fail under such a condition.

The degree of response can be determined from the selection of the seal material and the bushing internal pressure. The insulation medium in a preferred configuration has no determined shape (such as bushing oil), so its pressure can apply evenly to the inside surface of the seal and can assist in maintaining its functionality. The bushing spring loading, outside atmosphere and dielectric medium pressure are designed to properly function with the seal design.

The seal seals during the extreme static loading condition. Under extreme static bending conditions, such as when a long icy cable hangs from the bushing, the bushing components are tilted significantly. As in the asymmetrical dynamic loading condition described above, the seal described in several of the illustrative embodiments herein can also respond to this condition. In yet other embodiments, an adhered seal may be used alternatively to maintain a seal.

Generally speaking, motion in the Z-direction can be relatively better handled by several illustrative embodiments described herein with the seal, which allows, for example, the upper part to move longer distance (e.g., several inches). At the same time, the upper part of the bushing can move in the opposite direction to that of the bushing center of mass during resonance in an earthquake, because the driving force (at the center of mass) is 180° apart from the displacement (at the direction of the top end of the upper part of the bushing). The seal described in several illustrative embodiments can modulate itself to properly seal when the seal spacing is changed. This self-modulating seal may also alternatively be adhered to respective adjacent bushing components. Alternatively, the seal described as adhered using an adhesive in alternate embodiments herein can also be utilized.

Several of the illustrative embodiments described herein can also serve as a central impact shock absorber which can limit the movement of the bushing components eccentrically (in x and y directions). In this condition, the seal can also modulate its shape to protect the bushing components from directly impacting each other.

The seal of several illustrative embodiments herein is flexible enough to respond to the difference in bushing internal pressure change, while also rigid enough to maintain its shape when the load is removed. The seal described herein can be in some embodiments square-shaped, such as a square tube or solid rectangular prism shape. However, other suitable shapes can be also used, for example, U shape or cone shape, etc., that concentrate the force in certain areas and/or directions as necessary. When other shapes of seal are used, the bushing internal pressure could also alter the seal shape so it will conform to the sealing surfaces and hence perform the same function as square seal.

Several bushing insulating materials may be utilized in a bushing including mineral oil, compressed gases, foam, etc. The air/gas on the bushing top could be compressed or uncompressed. In some situations, there is only one compressed medium inside the bushing with pressure higher than that outside of the bushing. The configuration of the illustrative embodiments can be modified to accommodate each of these design types.

The description herein uses earthquakes as example of an application for the bushing. However, in other events such as during a circuit breaker open or close operation, the bushings installed on the top of the circuit breaker may experience random mechanical shocks. The illustrative embodiments described herein may also function well under such extreme conditions.

Figure 1:
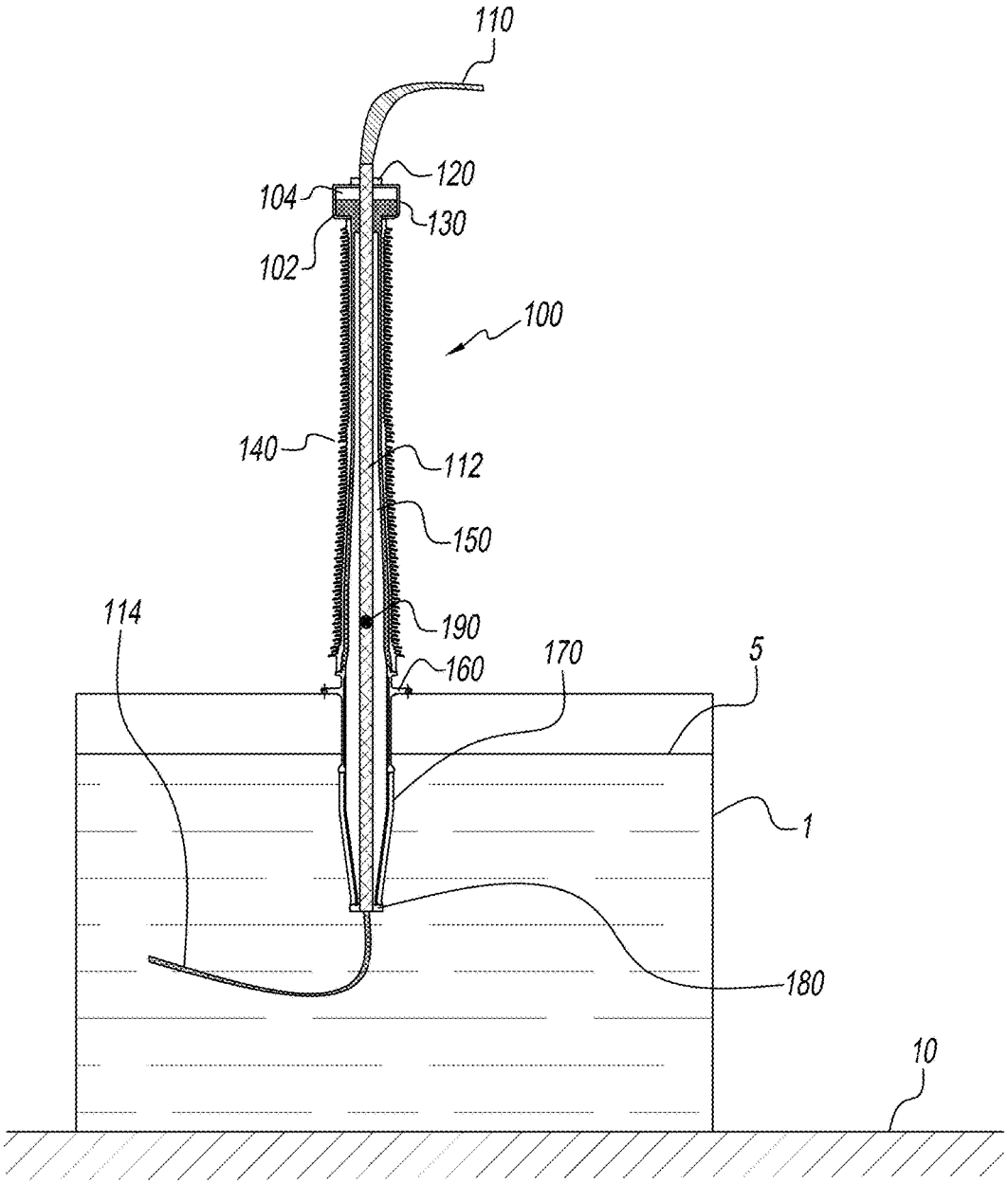
FIG. 1 is a cutaway side view of a bushing according to an illustrative embodiment of the present application.

Referring to FIG. 1, a cutaway side view of a bushing 100 according to an illustrative embodiment of the present application is shown. Here, the bushing 100 is shown installed on a power transformer 1 with insulating oil 5, wherein the power transformer 1 is installed on the ground surface 10. Here, a top portion of a power line/cable 110 would be connected to a bus (not shown) in a large power substation (not shown). The power line 110 is aluminum, but could alternatively be made of a conductor including copper or other suitable materials.

A top collar/nut 120 is provided made from brass, but other materials such as aluminum or other appropriate material or alloy may be utilized. A top cap (not shown) may be used in configurations that do not use a top expansion tank and spring expansion mechanism 130. Here, the top expansion tank and spring mechanism includes a housing made of aluminum and an appropriate spring mechanism (not shown). As can be appreciated, other materials and spring mechanisms may be utilized. An air or other gas space 104 is displaced at the top of tank 130 and bushing medium such as mineral oil, gas, foam or synthetic medium 102 is displaced toward the bottom of tank 130. Other suitable bushing medium 102 may be utilized as appropriate.

A bushing housing or insulator ("insulator") 140 is provided that is operatively connected at its top end to the bottom of the tank 130, wherein the bottom inner surface of the tank 130 is open to the inside of the insulator 140. The insulator 140 is shown here as porcelain, but could also be made of other insulating materials. Insulator 140 can include one or more sheds, radially extending from the outer surface with a smooth inner surface for containing the bushing core 150, the bushing medium 102 and the center portion of the conductor 112. Here again the conductor 112 is aluminum, but could alternatively be made of a conductor including copper or other suitable materials. The insulator 140 may be made of other suitable materials such as appropriate polymers. The bushing core 150 is made of paper, but could also be made of other suitable materials such as a resin.

The insulator 140 is operatively connected, generally at its bottom end, but adjacent to and as shown overlapping with a bushing mounting flange 160, generally at a top end of the flange 160. Here, the lower inner surface of the upper insulator 140 is open to the upper inside of the bushing mounting flange 160 with the seal and interface shown in detail below. This configuration will be shown and described more thoroughly below in exploded cutaway views taken at different physical states during an extreme motion event. The flange 160 is constructed of aluminum, but alternative materials such as steel or other suitable material may be utilized.

The bushing mounting flange 160 is operatively connected at its bottom end to a bushing lower insulator 170 at its upper end. Here, the lower inner surface of the flange 160 is open to the upper inside of the bushing lower insulator 170. The bushing lower insulator 170 is constructed of porcelain, but alternatively other suitable materials such as a polymer may be utilized. Bushing bottom cap 180 is made of aluminum or other suitable material such as copper or brass and is shown capping the bottom of lower insulator 170 with lower lead connector 114 passing though for connection to the transformer 1 windings (not shown). In some applications, the lead connector 114 and the power line/cable 110 are the same conductor which passes through the center of the hollow conductor 112. Lower lead connector 114 is made from copper, but other suitable conductor material such as aluminum or an alloy may be utilized. Finally, a center of gravity of such an illustrative bushing can be calculated such as located at or about point 190 as shown.

Figure 2:
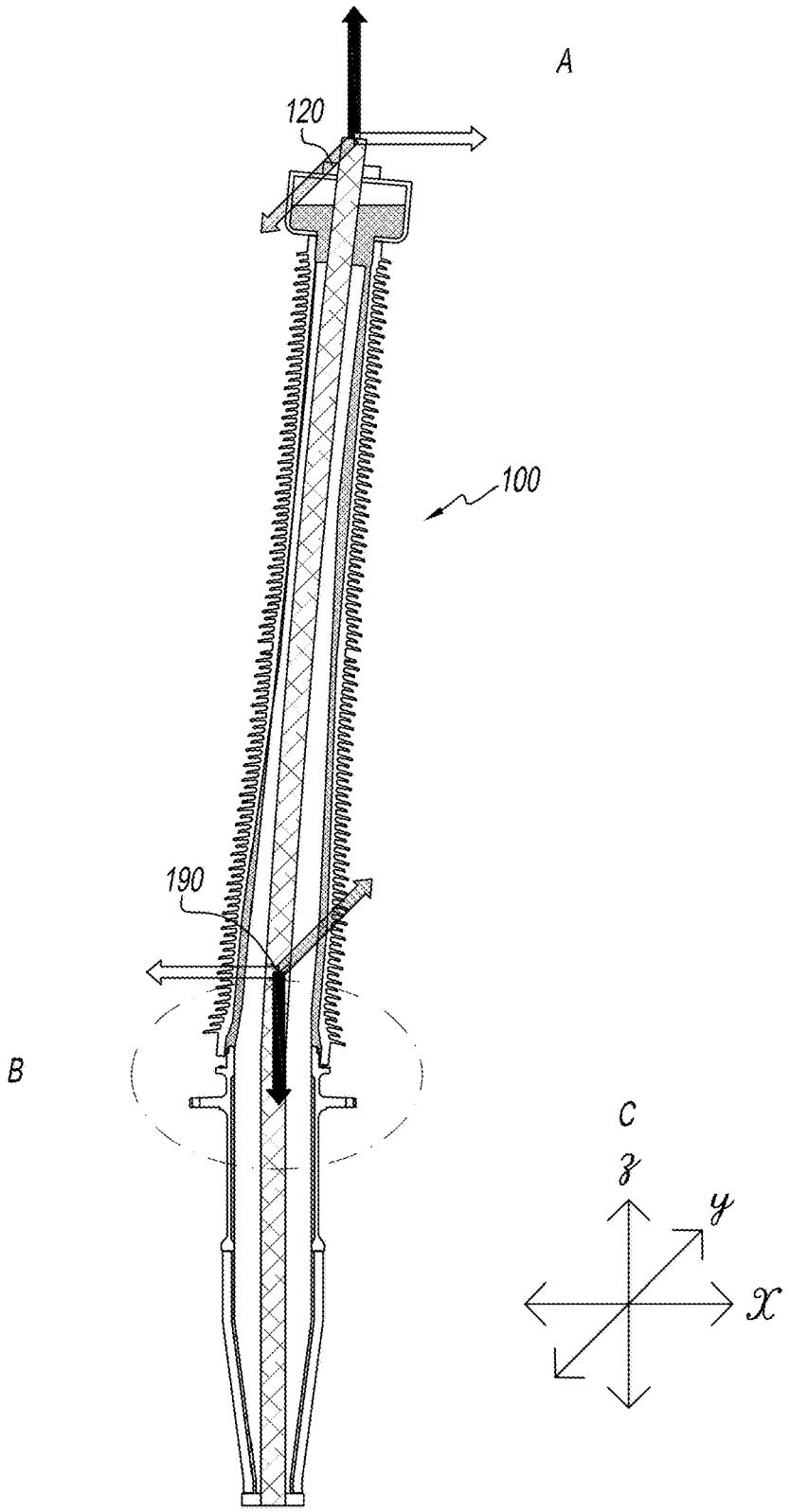
FIG. 2 is a view of the bushing of FIG. 1 under a severe dynamic load condition according to an illustrative embodiment of the present application.

Referring to FIG. 2, a partial cutaway side view of bushing 100 under load according to an illustrative embodiment of the present application is shown. Here a motion state during an extreme load event for the bushing 100 is shown. The direction of the motion induced by the extreme load such as, but not limited to an earthquake, is depicted by C. The bushing center of mass 190 is shown in a motion state at B and bushing top at approximately a location of the nut 120 is shown at A.

Figure 3:
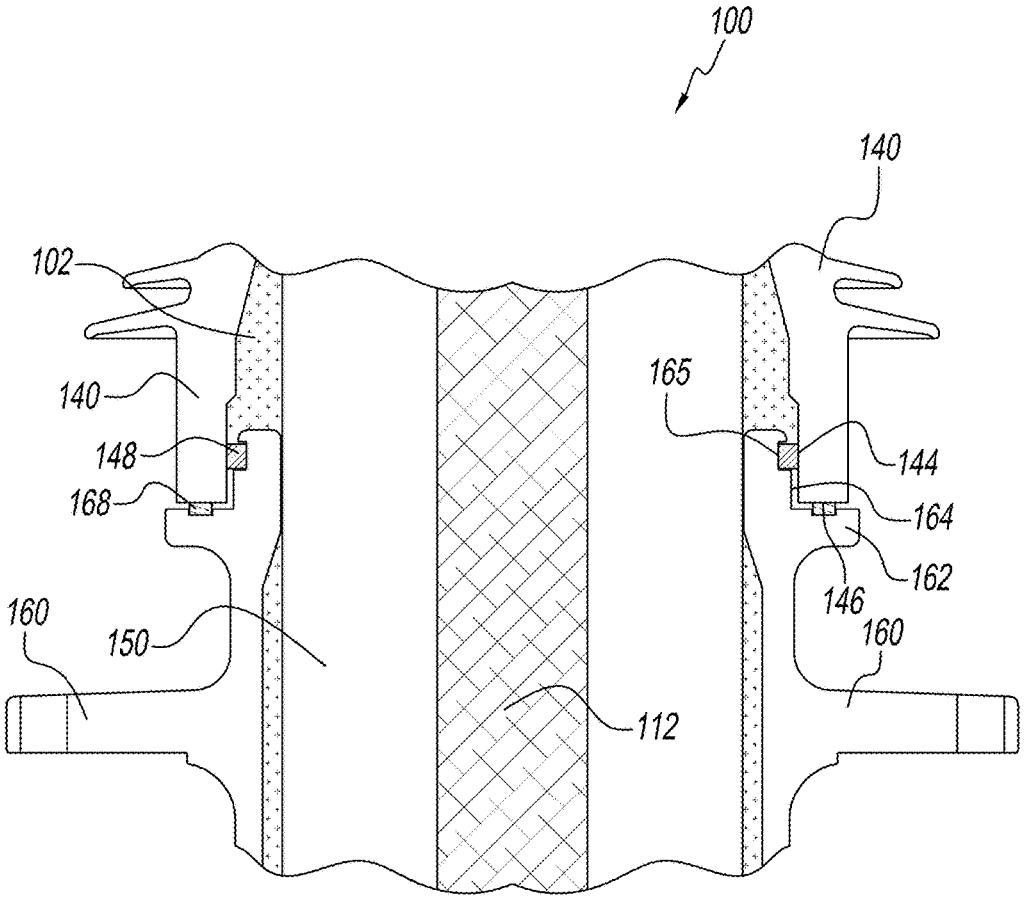
FIG. 3 is a magnified view of the bushing of FIG. 1 without application of an external load.

Referring to FIG. 3, a magnified view of bushing 100 without load according to an illustrative embodiment of the present application is shown. Here, the bushing center conductor 112 is shown disposed in the center of the bushing. Bushing core 150 is shown encircling the conductor 112 and bushing medium 102 is shown contained by seal 148. Here, seal 148 is a self-modulating seal in a solid square or rectangular shape that is made from hydrogenated nitrile butadiene rubber (HNBR). Alternatively, other shapes may be used such as a somewhat hollow square or rectangular shape and other suitable materials such as rubber may be used.

Also shown in FIG. 3, bushing 100 is illustrated having a bumper 168 which may not be required in all design philosophies. The bumper could be made of cork, Viton, nitrile, or other appropriate materials. The bumper is at the top of a portion 162 of the flange 160. Here, portion 162 of flange 160 forms a bottom of an "L" shape top of the flange 160 where the top of the "L" shape 164 of the flange 160 is shown. Here, bumper 168 operatively connects the bottom portion 146 of upper insulator 140 in the bottom of the "L" shape of the flange.

Seal 148 is illustrated mounted in a groove 165 in the top of the "L" shape of flange 160. In an alternative, the seal is adhered to the groove 165 using an adhesive or directly to flange 160 where the flange lacks the groove. The other side of the seal 148 is adjacent to portion 144 of an inside portion of the upper insulator 140. In an alternative, the seal is adhered to the portion 144 using an adhesive.

In the illustrated embodiment, bushing 100 is configured so that seal 148 is positioned between vertical surfaces and, when present, bumper 168 is positioned between horizontal surfaces. Without wishing to be bound by any particular theory, it is believed that the positioning of seal 148 between vertical surfaces, in combination with the square or rectangular shape—and when present grooves 165 and/or adhesives—together ensure that seal utilizes the pressure difference to self-modulate and remain sealed under extreme dynamic conditions during for example an earthquake. As used herein the term "vertical" shall mean along a longitudinal axis (also called the axial direction) of bushing 100 and the term "horizontal" shall mean perpendicular to the longitudinal axis of the bushing 100.

It should be recognized that seal 148 is described herein as having a square or rectangular shape that assists in self-modulation. It is believed that the flat or planar upper and lower surfaces—namely the surfaces that bound or face medium 102 and the ambient air outside of bushing 100—provide the necessary surfaces on which the pressure acts to provide, at least in part, self-modulation of seal 148. Thus, it is contemplated by the present disclosure for seal 148 to at least have planar upper and lower surfaces—except as modified in the embodiments discussed herein below.

Figure 4:
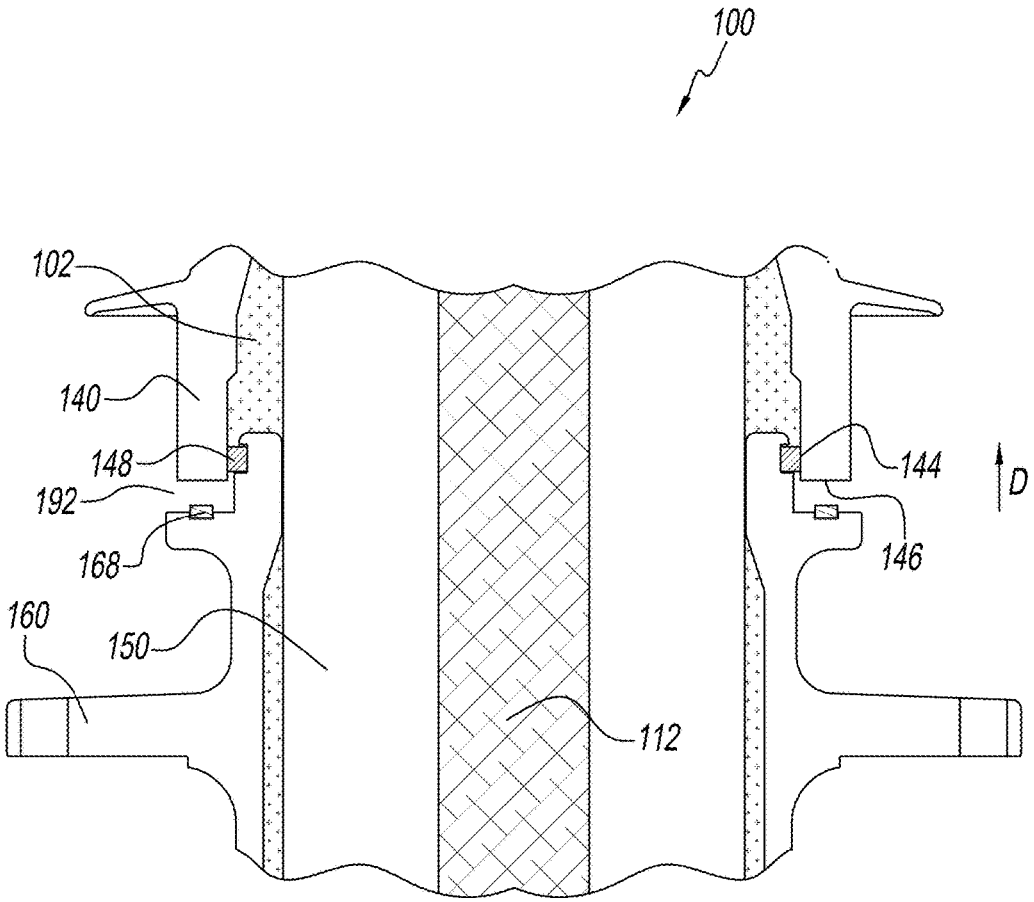
FIG. 4 is a magnified view of the bushing of FIG. 1 under an axial load.
Figure 5:
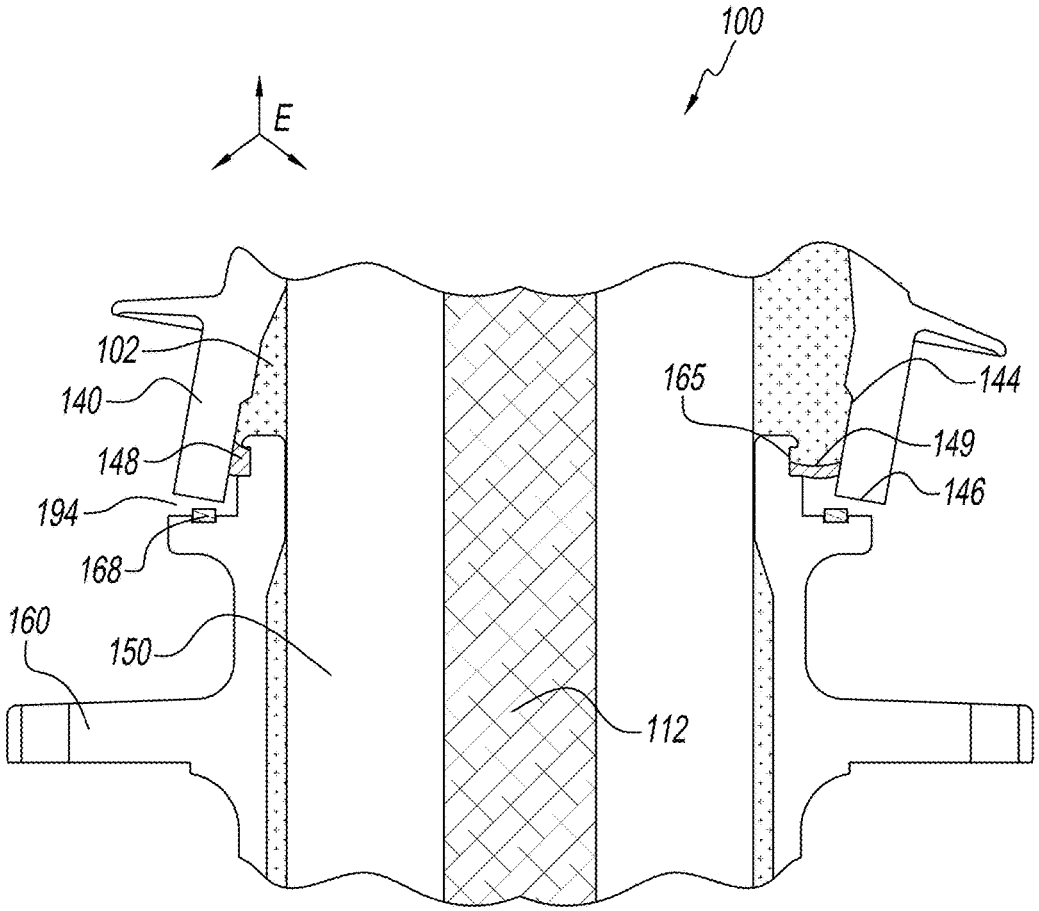
FIG. 5 is a magnified view of the bushing of FIG. 2 under the severe dynamic load condition.
Figure 6:
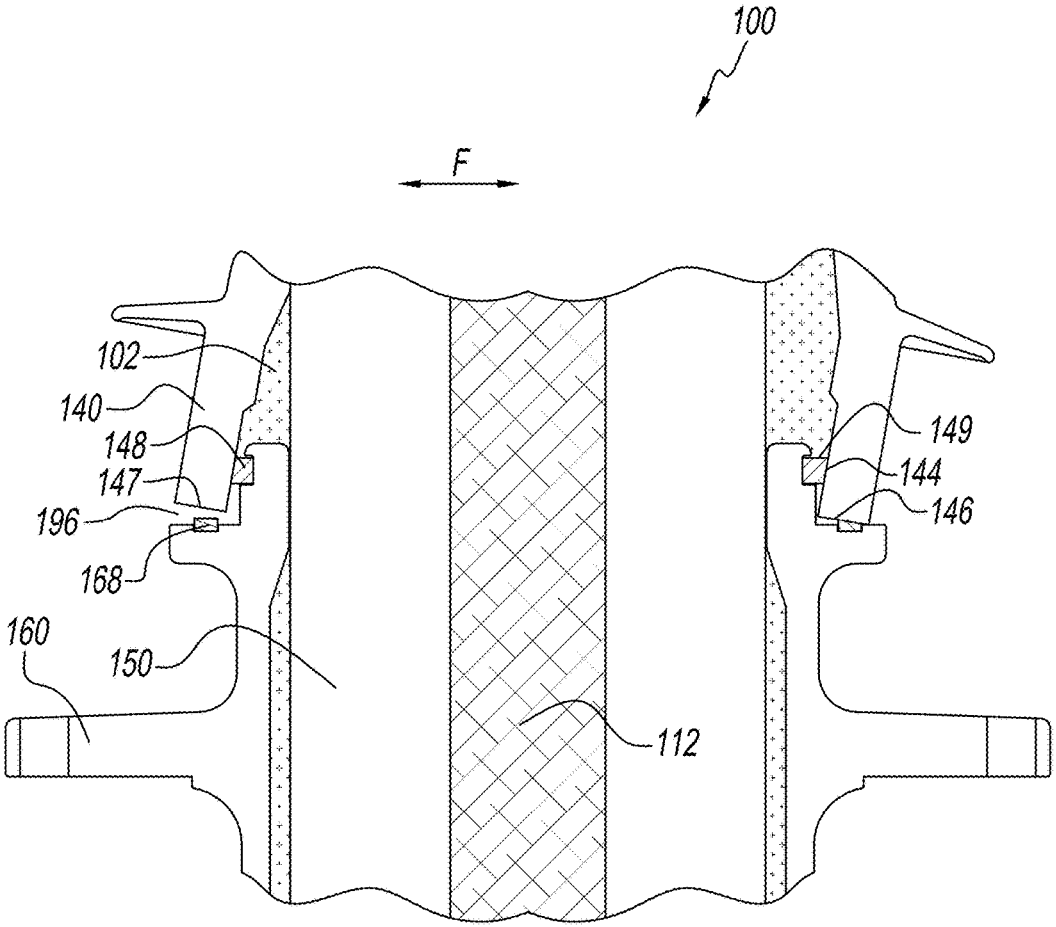
FIG. 6 is a magnified view of the bushing of FIG. 1 under a rotational or bending load.

The self-modulation of seal 148 in bushing 100 is described in more detail with respect to the dynamic and static loads of FIGS. 4-6.

Referring to FIG. 4, a magnified view of bushing 100 with an axial load according to an illustrative embodiment of the present application is shown. Here, the bushing upper insulator 140 is shown pulled axially up and away from flange 160 in direction D. The bottom portion 146 of the upper insulator 140 is no longer adjacent to the bumper 168 (assuming the bumper is present) and has been lifted up and away from the bumper. Here, the inner surface 144 of the upper insulator slides up from the seal 148 and the seal maintains its seal on the inside surface of upper insulator 140. As can be appreciated, the directions of the forces that may be applied are not limited and the instantaneous state of the device depends on the prior location of the components and the prior forces applied. Here, multiple forces can occur simultaneously and multiple directions of movement can occur. Gap 192 is created between the bottom 146 of the insulator 140 and the top of the bumper 168.

It is noted that seal 148 remains seated on flange 160 in this embodiment in a desired position, at least in part, due to groove 165 and/or adhesive, when present. Of course, it is contemplated by the present application as will be described in more detail for seal 148 to alternately remain in a desired position on inner surface 144 by way of another groove and/or adhesive. Moreover, it is contemplated by the present application as will be described in more detail for seal 148 to remain in a desired position on both flange 160 and inner surface 144 by way grooves and/or adhesives.

Referring to FIG. 5, a magnified view of bushing 100 with asymmetric dynamic load according to an illustrative embodiment of the present application is shown. Here, the bushing upper insulator 140 is shown pulled up and away from flange 160 by multi-directional forces E. The bottom portion 146 of the upper insulator 140 is no longer adjacent to the bumper 168 and has been lifted up and away from the bumper. Here, the portion of the seal 148 shown at location 149 has deformed to be thinner in height filling less of gap 165, but maintaining the seal. The other side of seal 148 is shown deformed slightly thicker and gap 194 is formed. Here, the insulation medium pressure and the air/gas pressure at the tank 130 push the seal 148 such as at portion 149 to self-modulate the seal and assist in maintaining the seal between the flange 160 and the upper insulator 140.

Referring to FIG. 6, a magnified view of bushing 100 under a rotational or bending load according to an illustrative embodiment of the present application is shown. Here, the bushing upper insulator 140 is shown pulled away from flange 160 by a force F such as by heavy ice on a power line. This force can be static such as when the ice or snow is merely resting on the power line, but can also have a dynamic component such as would be introduced by wind, rain, and/or additional precipitation as often occurs in inclement weather events.

The bottom portion 146 of the upper insulator 140 is driven into the respective portion of bumper 168 and the other side bottom portion 147 of the upper insulator 140 has been lifted up and away from the respective portion of bumper 168. Here, the portion of the seal 148 shown at location 149 has deformed slightly, but maintaining the seal. The other side of seal 148 is shown deformed slightly and gap 196 is formed.

Again and without wishing to be bound by any particular theory, it is believed that the positioning of seal 148 between vertical surfaces, in combination with the square or rectangular shape or at least the planar upper and lower surfaces—and when present grooves 165 and/or adhesives—together ensure that seal utilizes the pressure difference to self-modulate and remain sealed under the conditions depicted of FIGS. 4-6 as well as other loading conditions that may occur.

Referring to FIG. 7, a magnified view of a bushing 200 according to another illustrative embodiment of the present application is shown. Here, the other components are similar to those of bushing 100, but the seal design 248 has been modified to an adhered "inside" design. Here, seal 248 is a flexible seal that is adhered to the inside of the upper insulator 140 and the inside of flange 160 as shown. Seal 248 has sufficient flexibility to maintain omnidirectional mobility relative to the surfaces being sealed, namely relative to insulator 140 and flange 160, and, thus, is considered to be self-modulating. Seal 248 is made of a material selected from the group consisting of Hydrogenated Nitrile Butadiene Rubber or similar functioning materials that would be properly selected for the operating environment by someone familiar in the art of bushing design.

Seal 248, similar to seal 148, is positioned between horizontal surfaces and, due to the adherence remains sealed under the conditions depicted of FIGS. 4-6 as well as other loading conditions that may occur. Seal 248 can be adhered to upper insulator 140 and the inside of flange 160 using any adhesive sufficient to withstand the environment and materials of bushing 200. In one embodiment, seal 248 is adhered to upper insulator 140 and the inside of flange 160 using an oil-resistant room-temperature-vulcanized (RTV) silicone gasket making material.

Referring to FIG. 8, a magnified view of a bushing 300 according to another illustrative embodiment of the present application is shown. Here, the other components are similar to those of bushing 100, but the seal design 348 has been modified to an adhered "outside" design. Here, a seal 348 is a flexible seal adhered to the outside of the upper insulator 140 and the outside of flange 160 as shown. Seal 348 has sufficient flexibility to maintain omnidirectional mobility relative to the surfaces being sealed, namely relative to insulator 140 and flange 160 and, thus, is considered to be self-modulating.

Seal 348 is made of any material sufficient to withstand the environment of bushing 300. In one embodiment, seal 348 is made of Hydrogenated Nitrile Butadiene Rubber. Here, seal 348 can be designed to stretch seal over the insulator and flange forming a friction fit with the insulator and flange. Together with the friction fit or instead of stretching over the insulator and flange, seal 348 can, in some embodiments, further include a mechanical connector and/or an adhesive connection to provide an added safety margin. The mechanical connection can be provided using mechanical straps (not shown) that are UV and weather resistant. The adhesive connection can be provided using any desired adhesive sufficient to withstand the environment of bushing 300.

Figure 9:
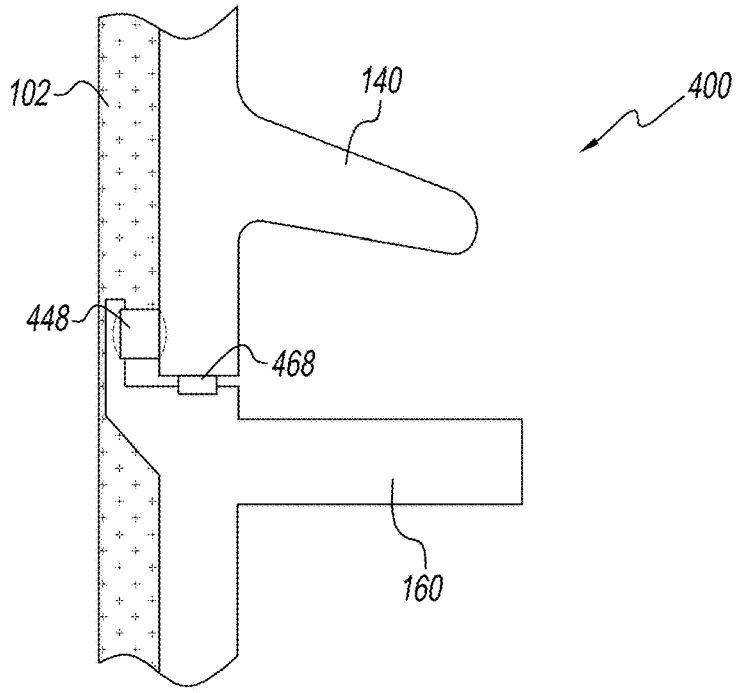
FIG. 9 is a magnified view of an exemplary embodiment of a bushing according to the present application without application of an external load.

Referring to FIG. 9, a magnified view of a bushing 400 according to another illustrative embodiment of the present application is shown. Again, the other components are similar to those of bushing 100 and, thus, are numbered accordingly. Bushing 400 includes a seal 448 positioned between the outside of the upper insulator 140 and the inside of flange 160 as shown to maintain bushing medium 102 within the bushing 400. In the illustrated embodiment, the surfaces of insulator 140 and flange 160 that contact seal 448 are substantially planar—namely lack the groove of prior embodiments.

Seal 448 has flat or planar upper and lower surfaces—namely the surfaces that bound or face medium 102 and the ambient air outside of bushing 400—provide the necessary surfaces on which the pressure acts to provide, at least in part, self-modulation of seal 448. Additionally, seal 448—before assembly—has outwardly curved side faces—shown in FIG. 9 in phantom. Upon assembly in bushing 400, the outwardly curved side faces are compressed to provide a predetermined loading or compression force in seal 448.

Again and without wishing to be bound by any particular theory, it is believed that the positioning of seal 448 between vertical surfaces, in combination with the planar upper and lower surfaces ensure that seal utilizes the pressure difference to self-modulate and remain sealed under the extreme loading conditions that may occur.

Bushing 400 is illustrated having a bumper 468 which may not be required in all design philosophies. The bumper could be made of cork, Viton, nitrile, or other appropriate materials. The bumper positioned between an upper surface of the flange 160 and a bottom surface of insulator 140. In this embodiment, bumper 468 is protected or sealed from medium 102 by seal 448.

In some embodiments, seal 448 can be adhered using an adhesive to insulator 140 and/or flange 160.

Figure 10:
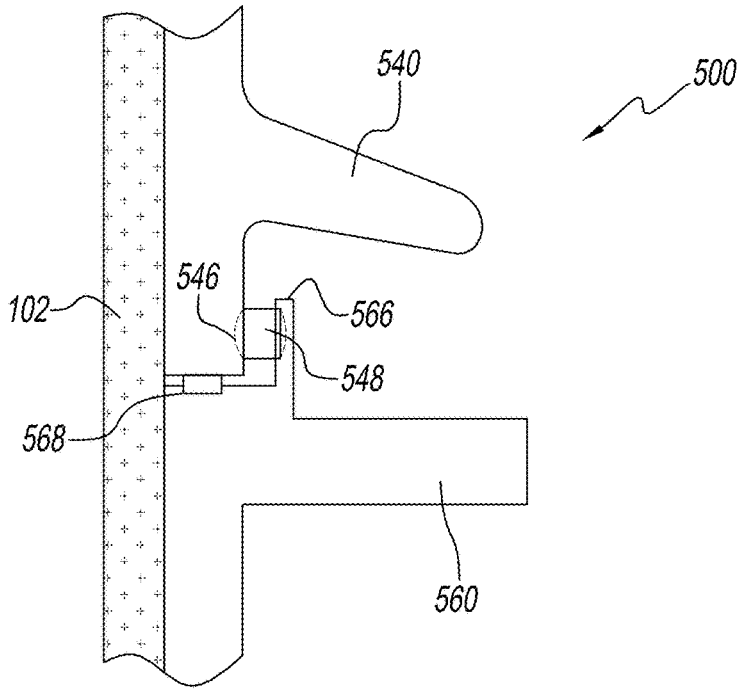
FIG. 10 is a magnified view of another alternate exemplary embodiment of a bushing according to the present application without application of an external load.

Referring to FIG. 10, a magnified view of a bushing 500 according to yet another illustrative embodiment of the present application is shown. Again, the other components are similar to those of bushing 100 and, thus, are numbered accordingly. Bushing 500 includes a seal 548 is positioned between an outside 546 of the upper insulator 540 and an inside 566 of flange 560 as shown to maintain bushing medium 102 within the bushing 500. In the illustrated embodiment, the surfaces of insulator 540 and flange 560 that contact seal 548 are substantially planar—namely lack the groove of prior embodiments.

Similar to seal 448, seal 548 has flat or planar upper and lower surfaces—namely the surfaces that bound or face medium 102 and the ambient air outside of bushing 500—provide the necessary surfaces on which the pressure acts to provide, at least in part, self-modulation of seal 548. Additionally, seal 548—before assembly—has outwardly curved side faces—shown in FIG. 10 in phantom. Upon assembly in bushing 500, the outwardly curved side faces are compressed to provide a predetermined loading or compression force in seal 548.

Again and without wishing to be bound by any particular theory, it is believed that the positioning of seal 548 between vertical surfaces, in combination with the planar upper and lower surfaces ensure that seal utilizes the pressure difference to self-modulate and remain sealed under the extreme loading conditions that may occur.

Bushing 500 is illustrated having a bumper 568 which may not be required in all design philosophies. The bumper could be made of cork, Viton, nitrile, or other appropriate materials. The bumper positioned between an upper surface of the flange 560 and a bottom surface of insulator 540. In this embodiment, bumper 568 is immersed in medium 102 since seal 548 is external to the bumper.

In some embodiments, seal 548 can be adhered using an adhesive to insulator 540 and/or flange 560.

Figure 11:
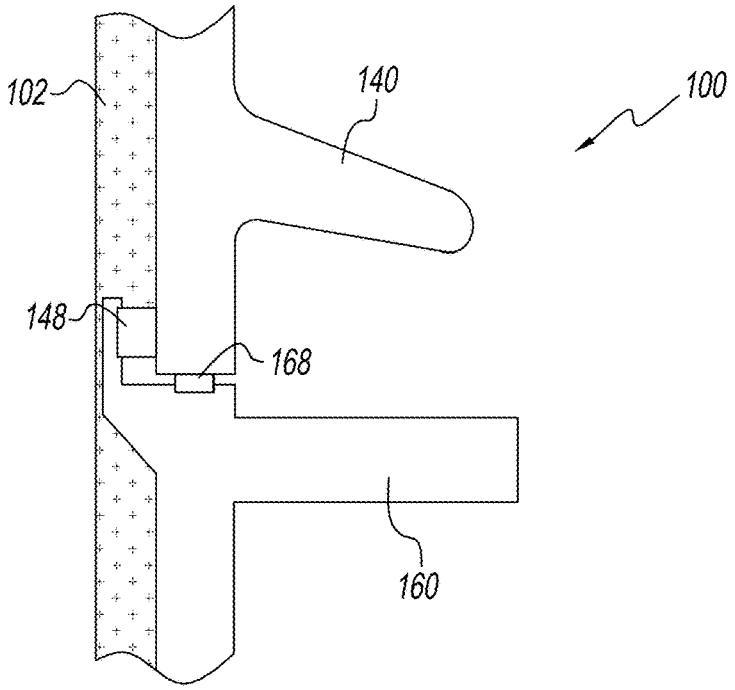
FIG. 11 is a magnified view the bushing of FIG. 3 without application of an external load.
Figure 12:
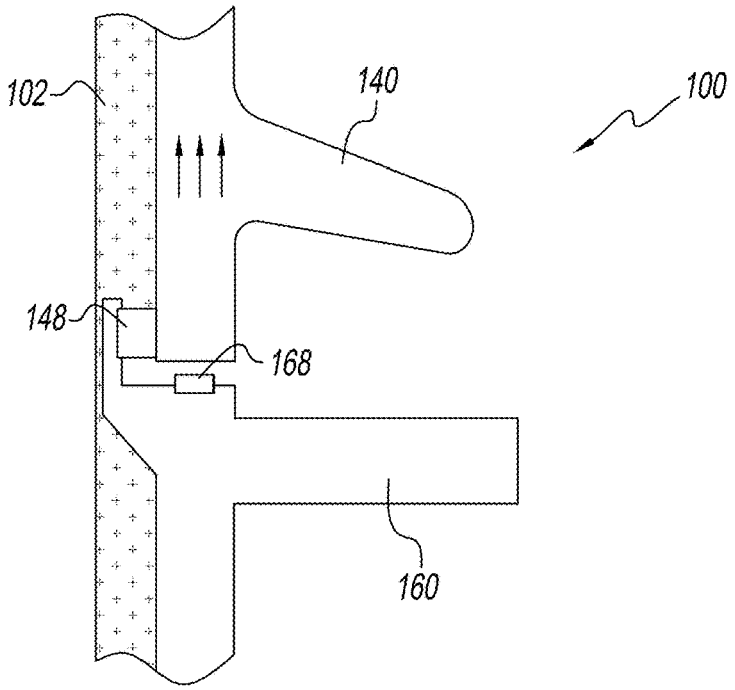
FIG. 12 is a magnified view of the bushing of FIG. 11 under an axial load.
Figure 13:
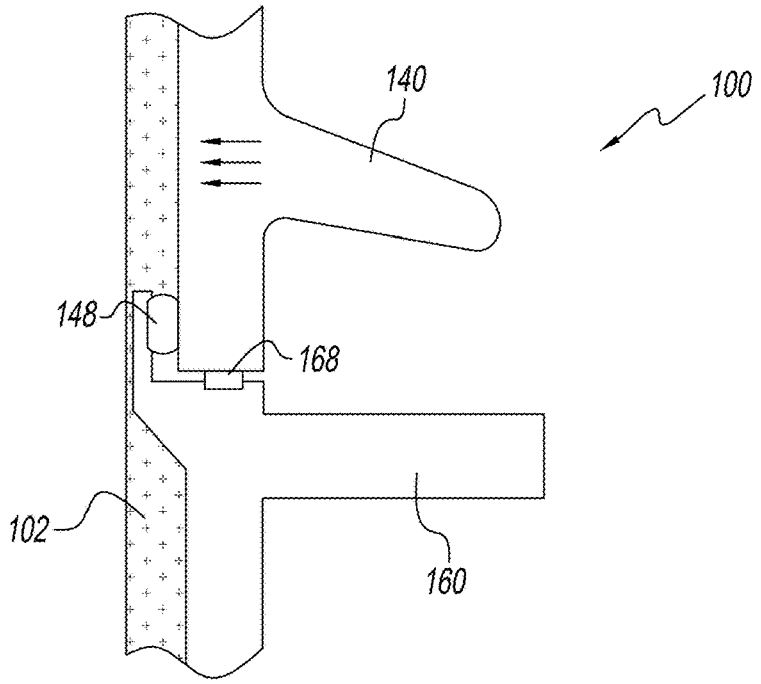
FIG. 13 is a magnified view of the bushing of FIG. 11 under an inward translational load.
Figure 14:
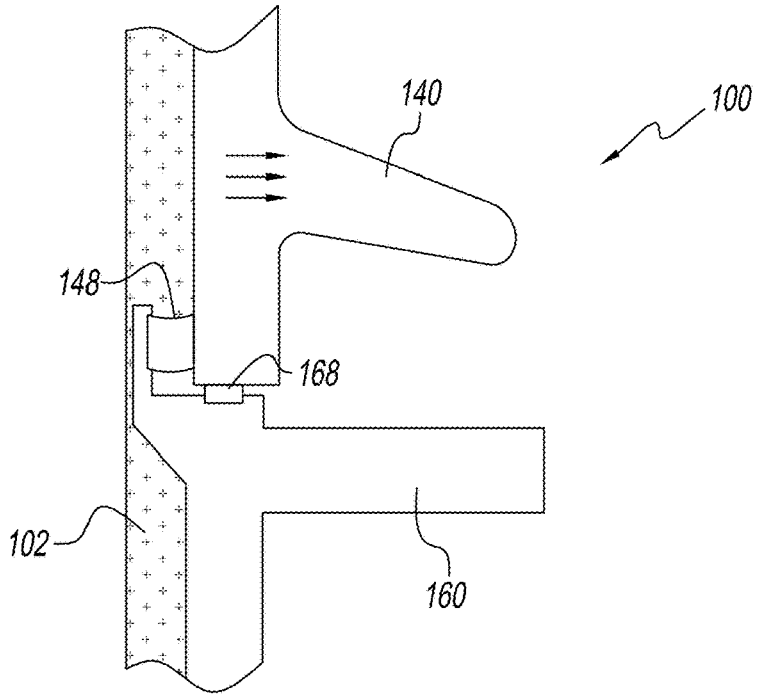
FIG. 14 is a magnified view of the bushing of FIG. 11 under an outward translational load.

Referring now to FIGS. 11-16, a magnified view of the embodiment of bushing 100 from FIG. 3 is shown under application of various forces. Bushing 100 is shown without application of an external load in FIG. 11, is shown under an axial load in FIG. 12, is shown under an inward translational load in FIG. 13, is shown under an outward translational load in FIG. 14, is shown under an inward rocking load in FIG. 15, and is shown under an outward rocking load in FIG. 16.

As shown in the unloaded state of FIG. 11, bushing 100 includes the solid square or rectangular shape self-modulating seal 148 and the square bumper 168 between flange 160 and insulator 140. During the axial load of FIG. 12, insulator 140 is displaced from bumper 168 and flange 160, while seal 148 is deformed in shear to remain sealed.

During the inward and outward translational loads of FIGS. 13 and 14, seal 148 is compressed and stretched as insulator 140 is displaced inward towards and outward from flange 160. Additionally, during the inward and outward translational loads of FIGS. 13 and 14, insulator 140 slides over bumper 168 to mitigate contact between the insulator and flange 160.

Figure 15:
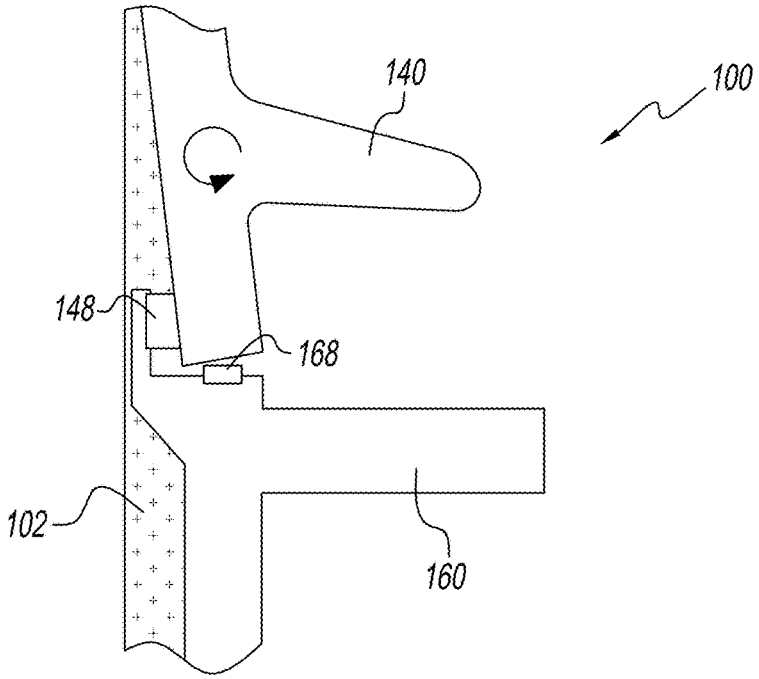
FIG. 15 is a magnified view of the bushing of FIG. 11 under an inward rocking load.
Figure 16:
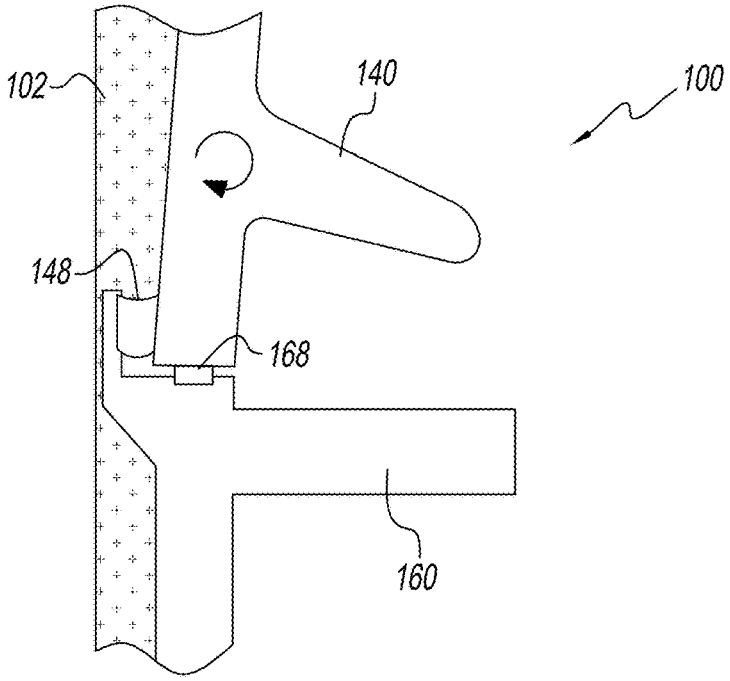
FIG. 16 is a magnified view of the bushing of FIG. 11 under an outward rocking load.

During the inward and outward rocking loads of FIGS. 15 and 16, seal 148 is compressed and stretched as insulator 140 is rocks towards and away from flange 160. Additionally, during the inward and outward rocking loads of FIGS. 15 and 16, bumper 168 mitigates contact between insulator 140 and flange 160.

As can be seen, regardless of the force applied to bushing 100 in FIGS. 12-16, bumper 168 is protected or sealed from medium 102 by seal 148.

Turning now to FIGS. 17 and 18*a*-18*d*, a partial sectional views and a magnified views, respectively, of a bushing 600 according to additional illustrative embodiments of the present application are shown.

Figure 17:
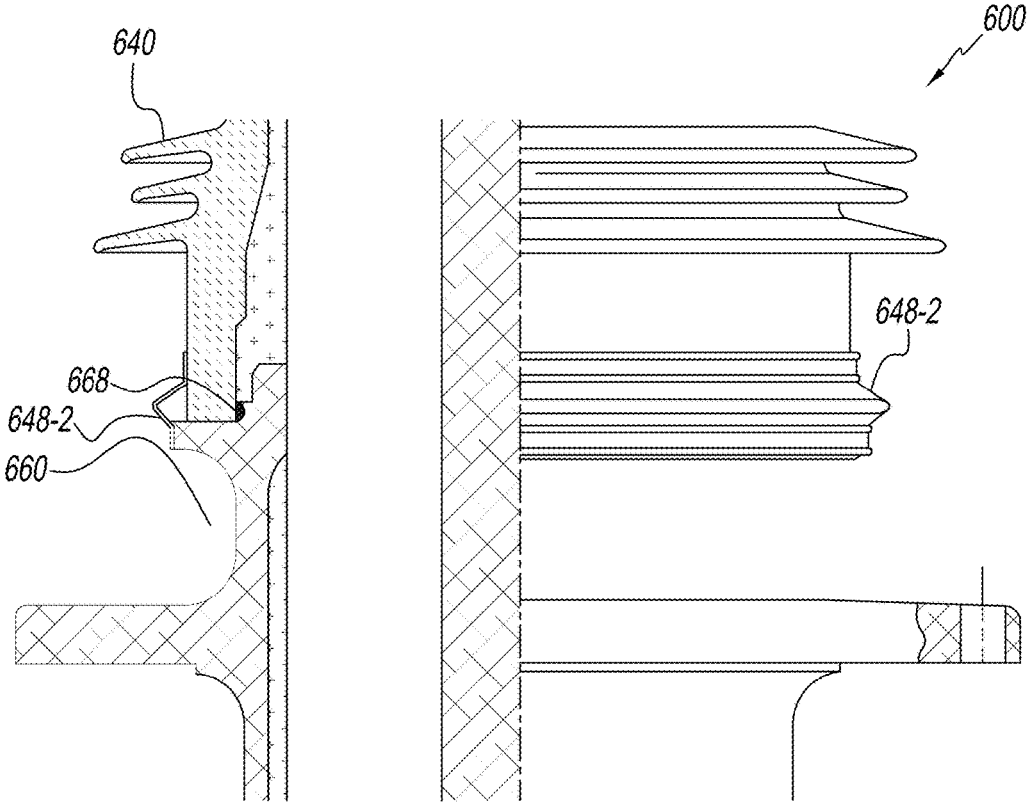
FIG. 17 is a partial sectional view of another alternate exemplary embodiment of a bushing according to the present application without application of an external load.
Figure 18A:
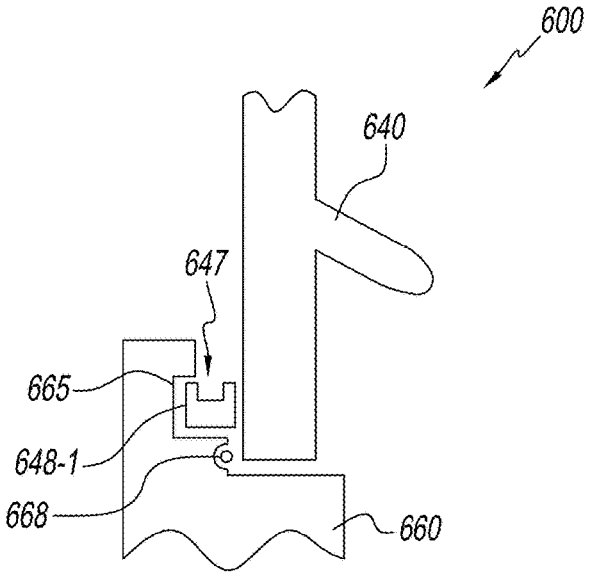
FIGS. 18*a*-18*d* are partial sectional view of other exemplary embodiments of bushings according to illustrative embodiments of the present application without application of an external load.
Figure 18B:
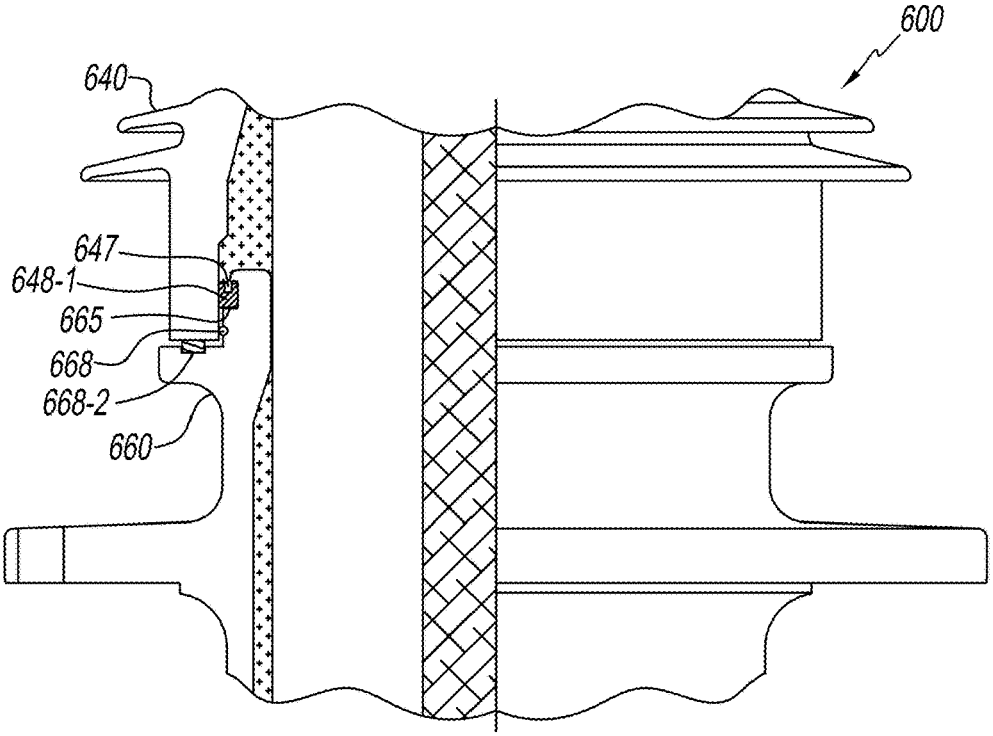
Figure 18C:
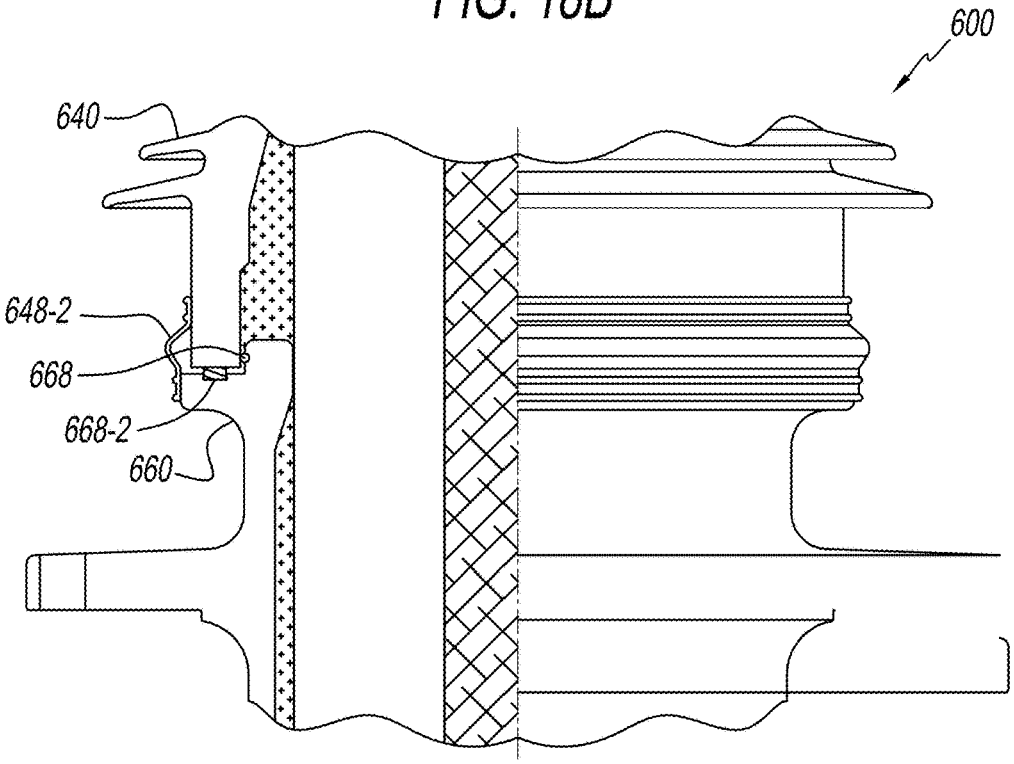
Figure 18D:
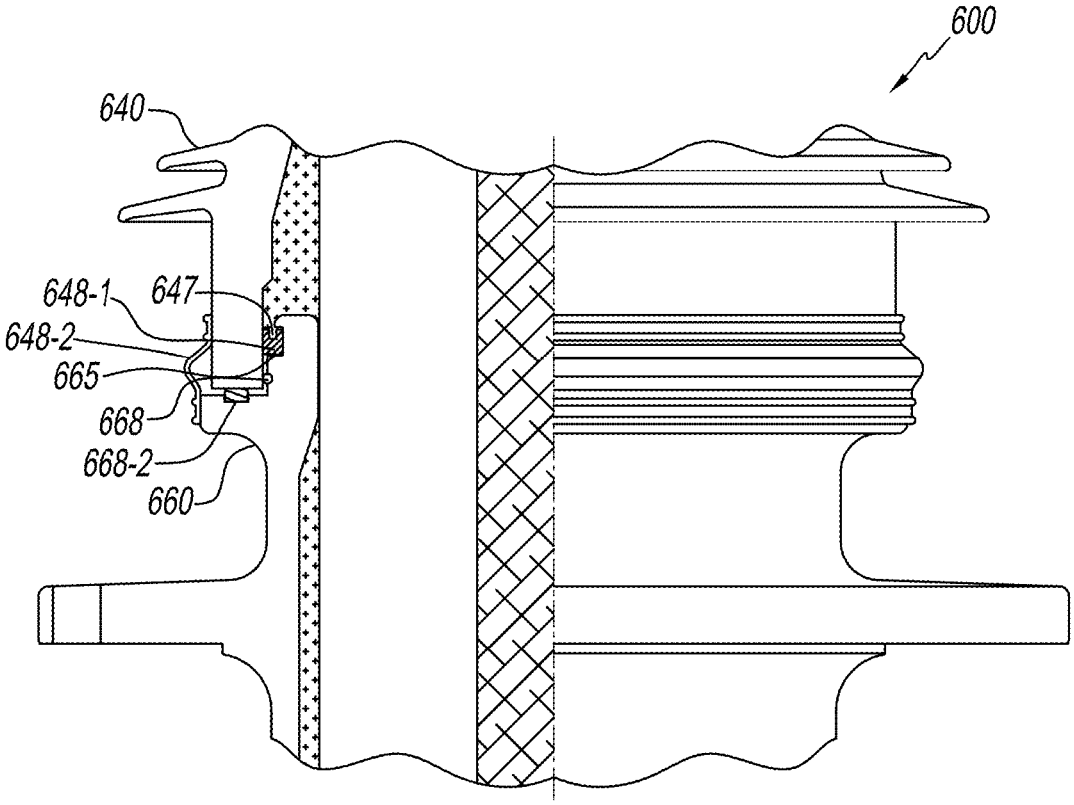

In FIGS. 18*a*-18*b*, and 18*d*, bushing 600 includes upper insulator 640 and flange 660, which are sealed to one another by an internal self-modulating seal 648-1. However, bushing 600 of FIGS. 17 and 18*c* lack internal self-modulating seal 648-1 as described herein below.

In some embodiments, seal 648-1, when present, can be adhered using an adhesive to insulator 640 and/or flange 660.

In FIGS. 17 and 18*a*-18*d*, upper insulator 640 is wider than and encloses lower insulator 660. Of course, it is contemplated by the present disclosure for each of the embodiments of FIGS. 17 and 18*a*-18*d* to be modified so that upper insulator 640 is narrower than and is enclosed by lower insulator 660.

Bushing 600 of FIGS. 17, 18*c*, and 18*d* include upper insulator 640 and flange 660, which are sealed to one another by an adhered outside seal 648-2 to maintain the bushing medium (not shown) within the bushing 600. Conversely, bushing 600 of FIGS. 18*a* and 18*b* lack adhered outside seal 648-2.

Seal 648-1, when present as in FIGS. 18*a*-18*b* and 18*d*, is positioned between vertical surfaces of insulator 640 and flange 660. Additionally, seal 648-1 has a planar lower surface exposed to the ambient pressure outside of bushing 600 and a notched upper surface 647. The notched upper surface 647 can have a shape such as the squared shape shown, a v-shape (not shown), a semi-circular shape (not shown), and others. Without wishing to be bound by any particular theory, it is believed that notched upper surface 647, particularly when combined with the planar lower surface, can ensure that seal 648-1 utilizes the pressure difference to self-modulate and remain sealed under the extreme loading conditions that may occur. Stated another way, it is believed that pressure within bushing 600 can act on the vertical walls of notched upper surface 647 to force seal 648-1 outwards to ensure the seal remains in contact with insulator 640 and flange 660.

In the illustrated embodiments, the surfaces of insulator 640 that contacts seal 648-1 is substantially planar—namely lack the groove of prior embodiments, while flange 660 includes a groove 665 defined therein to receive seal 648-1. Of course, it is contemplated by the present disclosure for either or both of insulators/flange 640, 660 to have a groove 665 as desired.

Bushing 600 is illustrated in FIGS. 17 and 18*a*-18*d* having a bumper 668 which may not be required in all design philosophies. The bumper could be made of cork, Viton, nitrile, or other appropriate materials. The bumper 668 is illustrated positioned between vertical surfaces of the insulator 640 and flange 660. In the embodiments having seal 648-1 (i.e., FIGS. 18*a*-18*b* and 18*d*), bumper 668 is protected or sealed from the bushing medium by seal 648-1.

Further, bushing 600 of FIGS. 17, 18*c*, and 18*d* includes outer seal 648-2 that is adhered to the outside of upper insulator 640 and the outside of flange 660 as shown. Outer seal 648-2 can be made of any desired material sufficient to withstand the environment of bushing 600. In one embodiment, outer seal 648-2 is made of Hydrogenated Nitrile Butadiene Rubber.

Additionally bushing 600 of FIGS. 18*b*-18*d* each include a second bumper 668-2 that operatively connects a bottom portion of upper insulator 640 and an opposing surface of flange 660.

Simply, bushing 600 can include any combination of one or more bumpers 668, 668-2 on vertical and/or horizontal surfaces, inner seal 648-1, and outer seal 648-2 as desired.

Moreover and applicable to any of the embodiments or alternative embodiments described herein, the self-modulating seal can include an adhered seal (inside, outside or both) may be utilized in the same bushing.

In an alternative applicable to any of the embodiments or alternative embodiments described herein, a groove may be formed on the inside of the upper insulator for engaging the seal. In yet another alternative, the seal may be adhered in such groove using an adhesive.

In an alternative applicable to any of the embodiments or alternative embodiments described herein, a bumper may be additionally or alternatively adhered to the bottom surface of the upper insulator for cushioning the adjacent positioning of the upper insulator to the flange.

Advantageously, the bushings of the present application, which include one or more of the self-modulating seal designs disclosed herein are uniquely capable of withstanding up to and exceeding the requirements for seismic performance as defined by IEEE 693-2005. In some embodiments, the bushings of the present application attain or exceed a High Performance Level as defined by IEEE 693-2005 shake table tests conducted at 2.5 g Zero Period Acceleration (ZPA).

While illustrative embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description.

What is claimed is:

1. An electrical bushing assembly, comprising:

a bushing insulator;

a flange housing;

a bushing medium disposed within the bushing insulator and the flange housing for fluid communication therebetween; and a self-modulating seal sealingly engaging a first portion of the bushing insulator to a second portion of the flange housing in a fluid/gas tight manner.

2. The electrical bushing assembly of claim 1, wherein the bushing insulator is selected from the group consisting of an upper bushing insulator, a lower bushing insulator, and combinations thereof.

3. The electrical bushing assembly of claim 1, wherein the first portion is a horizontal surface of the bushing insulator and the second portion is horizontal surface of the flange housing.

4. The electrical bushing assembly of claim 3, wherein the first portion is an inside portion of the bushing insulator and the second portion is an inside portion of the flange housing.

5. The electrical bushing assembly of claim 4, further comprising an adhesive adhering the self-modulating seal to the first and second portions.

6. The electrical bushing assembly of claim 5, wherein the adhesive comprises an oil-resistant room-temperature-vulcanized (RTV) silicone gasket making material.

7. The electrical bushing assembly of claim 5, further comprising a bumper between vertical portions of the bushing insulator and the flange housing.

8. The electrical bushing assembly of claim 7, wherein the bumper is immersed in the bushing medium.

9. The electrical bushing assembly of claim 8, wherein the electrical bushing assembly is sufficient to withstand IEEE 693-2005 shake table tests conducted at 2.5 g Zero Period Acceleration (ZPA).

10. The electrical bushing assembly of claim 4, wherein the first portion is larger than the second portion so that the bushing insulator surrounds the flange housing.

11. The electrical bushing assembly of claim 4, wherein the second portion is larger than the first portion so that the flange housing surrounds the bushing insulator.

12. An electrical bushing assembly, comprising:

a bushing insulator having a first portion;

a flange housing having a second portion, the first portion being larger than the second portion so that the bushing insulator surrounds the flange housing at the first and second portions;

a bushing medium disposed within the bushing insulator and the flange housing for fluid communication therebetween; and a self-modulating seal adhered to a horizontal surface at the first portion and adhered to a horizontal surface at the second portion of the flange housing so as to seal, in a fluid/gas tight manner, to maintain the bushing medium in the bushing insulator; and a bumper between vertical portions of the bushing insulator and the flange housing, the bumper being immersed in the bushing medium.

13. The electrical bushing assembly of claim 12, further comprising an adhesive adhering the self-modulating seal to the first and second portions.

14. The electrical bushing assembly of claim 13, wherein the adhesive comprises an oil-resistant room-temperature-vulcanized (RTV) silicone gasket making material.

15. The electrical bushing assembly of claim 12, wherein the electrical bushing assembly is sufficient to withstand IEEE 693-2005 shake table tests conducted at 2.5 g Zero Period Acceleration (ZPA).

* * * * *